US007077116B1

(12) United States Patent
Darlington

(10) Patent No.: US 7,077,116 B1
(45) Date of Patent: Jul. 18, 2006

(54) ARCHERY BOW LIMB ATTACHMENT

(76) Inventor: Rex F. Darlington, 6828 Maple Acres Dr., Whittemore, MI (US) 48770

( * ) Notice: Subject to any disclaimer, the term of this patent is extended or adjusted under 35 U.S.C. 154(b) by 0 days.

(21) Appl. No.: 11/007,873

(22) Filed: Dec. 9, 2004

(51) Int. Cl.
*F41B 5/00* (2006.01)

(52) U.S. Cl. ..... 124/23.1

(58) Field of Classification Search ..... 124/23.1, 124/25.6

See application file for complete search history.

(56) References Cited

U.S. PATENT DOCUMENTS

| | | | | |
|---|---|---|---|---|
| 5,231,970 | A | 8/1993 | Ploot et al. | |
| 5,339,790 | A | 8/1994 | Smith | |
| 5,515,836 | A * | 5/1996 | Martin et al. | 124/23.1 |
| 6,360,734 | B1 | 3/2002 | Andrews | |
| 6,571,785 | B1 * | 6/2003 | Choma | 124/25 |
| 6,886,549 | B1 * | 5/2005 | McPherson | 124/23.1 |

* cited by examiner

*Primary Examiner*—John A. Ricci
(74) *Attorney, Agent, or Firm*—Reising, Ethington, Barnes, Kisselle, P.C.

(57) ABSTRACT

An archery bow limb attachment construction includes a limb bolt washer having a flat undersurface opposed to an outer surface on the limb, a leg extending from the undersurface into a non-round opening in the limb to prevent rotation of the limb bolt washer with respect to the limb, a through-opening having a cylindrical countersink at an end opposed to the undersurface, and an internally threaded lateral opening communicating with the through-opening between the countersink and the undersurface. An annular bearing washer has a cylindrical outer periphery received in the countersink of the limb bolt washer, and a through-opening having a conical countersink remote from the limb bolt washer. A cap screw has a head received in the conical countersink of the bearing washer and an externally threaded shank that extends through the bearing washer, the limb bolt washer and the archery bow limb into an internally threaded opening in an archery bow handle riser. A set screw in the lateral opening of the limb bolt washer locks the cap screw against rotation with respect to the limb bolt washer.

9 Claims, 4 Drawing Sheets

ARCHERY BOW LIMB ATTACHMENT

The present invention is directed to a construction for attachment of an archery bow limb to a bow handle, and more particularly to an attachment construction for adjustably mounting the limb on a bow handle riser for adjusting the draw weight or force of the bow.

BACKGROUND AND SUMMARY OF THE INVENTION

U.S. Pat. No. 5,231,970 discloses an archery bow limb attachment construction that includes an archery bow limb adapted to be adjustably mounted to a planar mounting surface of a bow handle riser. The bow limb has an outer surface, an inner surface and a slot-shaped opening that extends through the limb between the outer and inner surfaces. A limb bolt washer or bushing has an undersurface in engagement with the outer surface of the limb and a leg that extends through the slot-shaped opening in the limb to prevent rotation of the bushing with respect to the limb. A cap screw has a head received in a conical countersink at the outer surface of the bushing, and a externally threaded shank that extends through the bushing and the slot-shaped opening of the limb into an internally threaded opening in the handle riser. A set screw extends through a lateral opening in the bushing to engage and lock the cap screw in an adjustably threaded position with respect to the bushing, limb and handle riser.

Although the archery bow limb attachment construction disclosed in the noted patent has enjoyed substantial commercial acceptance and success, improvements are desirable. For example, when the set screw in the noted patent is loosened, it can be difficult to adjust the draw weight of the bow limb because of the force required to overcome friction between the bolt head and the bushing. Friction between the bolt head and bushing can cause the bolt head to score the mating surface of the bushing, creating a source of noise while using the bow and becoming progressively harder to adjust the bow draw weight. It is a general object of the present invention to provide an archery bow limb attachment construction that addresses this problem in the prior art.

An archery bow limb attachment construction in accordance with one presently preferred embodiment of the invention includes a limb bolt washer having a flat undersurface opposed to an outer surface on the limb, a leg extending from the undersurface into a non-round opening in the limb to prevent rotation of the limb bolt washer with respect to the limb, a through-opening having a cylindrical countersink at an end opposed to the undersurface, and an internally threaded lateral opening communicating with the through-opening between the countersink and the undersurface. An annular bearing washer has a cylindrical outer periphery received in the countersink of the limb bolt washer, preferably by press fit, and a through-opening having a conical countersink remote from the limb bolt washer. A cap screw has a head received in the conical countersink of the bearing washer and an externally threaded shank that extends through the bearing washer, the limb bolt washer and the archery bow limb into an internally threaded opening in an archery bow handle riser. A set screw in the lateral opening of the limb bolt washer locks the cap screw against rotation with respect to the limb bolt washer.

In a presently preferred embodiment of the invention, there is a base washer disposed between the outer surface of the bow limb and the undersurface of the limb bolt washer. The base washer has a through-opening through which the cap screw shank is received, and a lug received in a pocket on the undersurface of the limb bolt washer to prevent movement and maintain alignment of the base washer with respect to the limb bolt washer. The base washer preferably includes an opening, most preferably a slotted opening at the periphery of the limb bolt washer diametrically opposite from the lug, for receiving the leg that extends from the undersurface of the limb bolt washer. The through-opening in the limb bolt washer preferably is enlarged at the undersurface to accommodate rocking of the cap screw with respect to the limb bolt washer as the bow limb is adjusted with respect to the handle riser, and the through-opening in the base washer preferably is elongated to accommodate rocking of the cap screw with respect to the base washer during such adjustment.

BRIEF DESCRIPTION OF THE DRAWINGS

The invention, together with additional objects, features, advantages and aspects thereof, will best be understood from the following description, the appended claims and the accompanying drawings, in which:

DETAILED DESCRIPTION OF PREFERRED EMBODIMENTS

Figure 1:
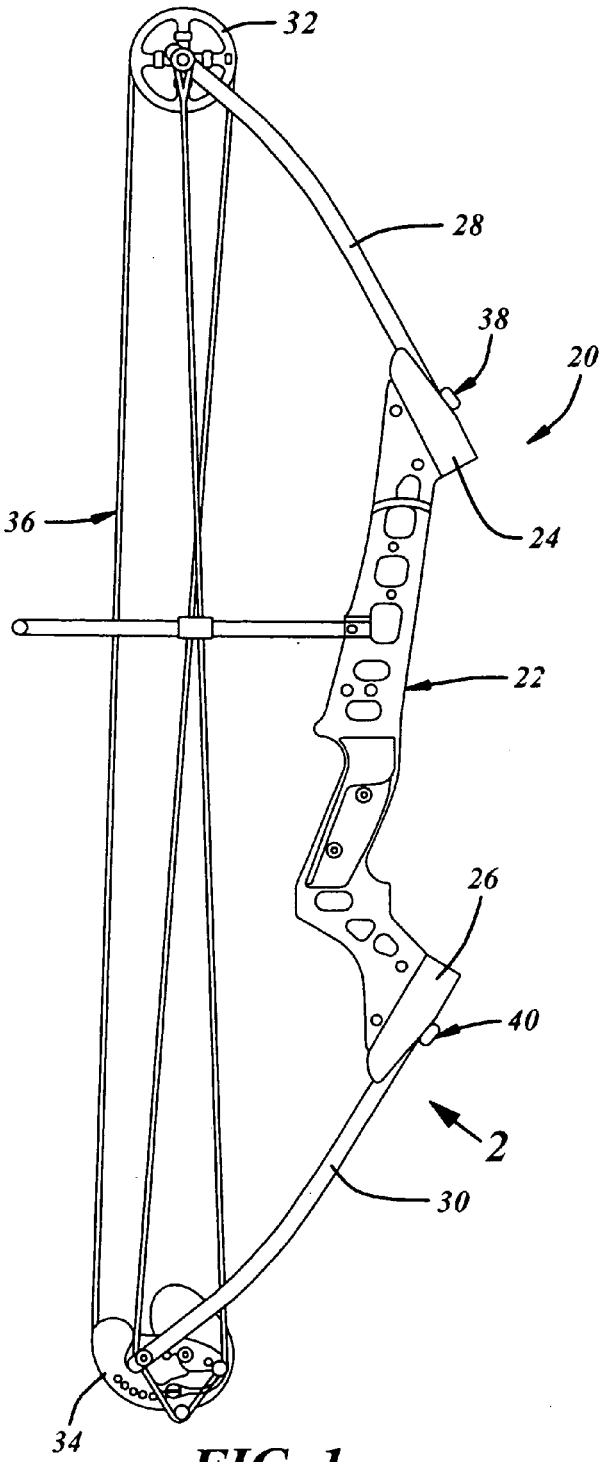
FIG. 1 is a side elevational view of an archery bow in accordance with one exemplary implementation of the present invention.
Figure 6:
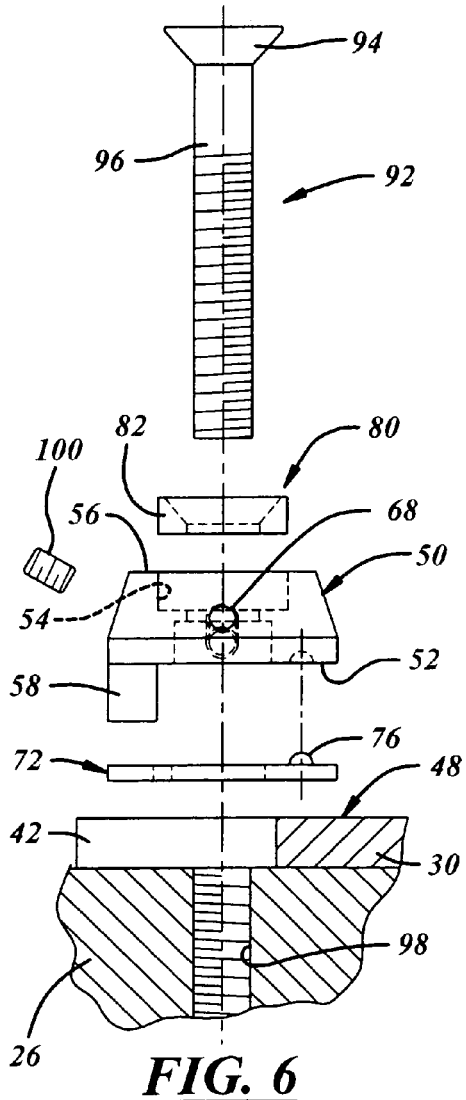
FIG. 6 is a fragmentary exploded view of the bow limb attachment construction illustrated in FIGS. 1–5.
Figure 2:
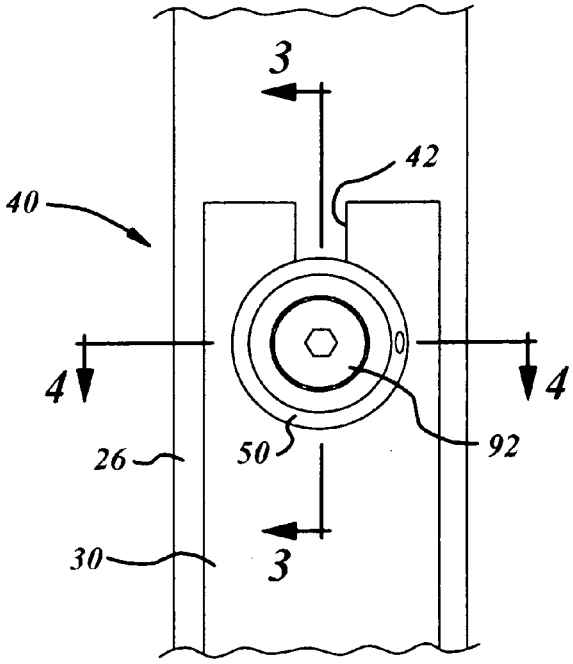
FIG. 2 is a fragmentary elevational view taken substantially from the direction 2 in FIG. 1.
Figure 3:
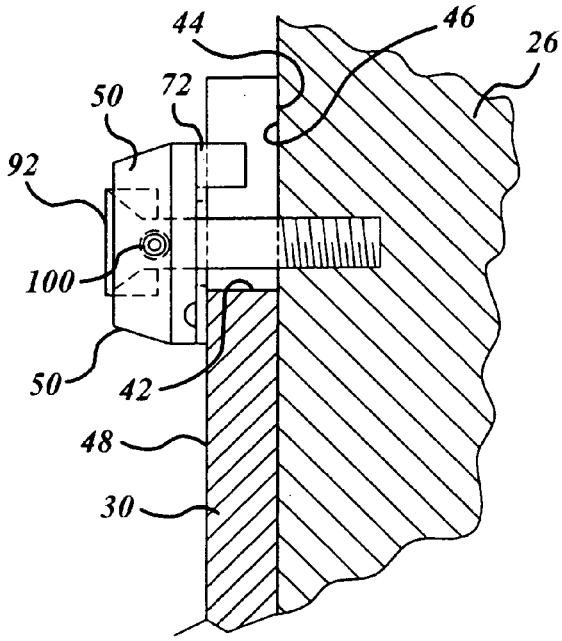
FIGS. 3 and 4 are fragmentary sectional views taken substantially along the lines 3—3 and 4—4 in FIG. 2.
Figure 4:
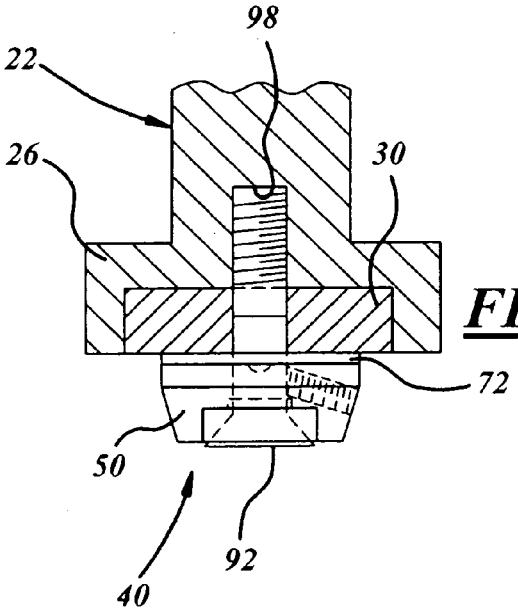

FIG. 1 illustrates an archery bow 20 in accordance with an exemplary implementation of the present invention. A handle 22 of aluminum or other relatively rigid construction has spaced risers 24, 26 with a flat limb-receiving surface at each end of the handle. A pair of flexible resilient limbs 28, 30 of fibre-reinforced resin or other suitable resilient construction are mounted on respective handle risers 24,26 and project away from handle 22. A first pulley 32 is mounted at the outer end of limb 28, and a second pulley 34 is mounted at the outer end of limb 30. A bow cable system 36 extends between pulleys 32, 34 for drawing the bow. Archery bow 20 in FIG. 1 is illustrated as a single-cam compound archery bow, but could be a dual-cam bow without departing from the present invention, which is directed to attachment of limbs 28,30 to handle 22. Limb 28 is attached to handle riser 24 by an attachment construction 38, and limb 30 is attached to handle riser 26 by an attachment construction 40. Constructions 38,40 preferably are identical, and attachment construction 40 will be described in detail in conjunction with FIGS. 2–9B.

Referring to FIGS. 2–9B, attachment construction 40 in accordance with a presently preferred embodiment of the invention includes a non-round opening 42 adjacent to the end of limb 30, preferably in the form of a slot that opens at the end of the bow limb. The slot may have straight sides or be keyhole-shaped as shown in above-noted U.S. Pat. No. 5,231,970. As another alternative, the through-opening can be keyhole-shaped or slot-shaped with straight sides but not open at the end of the limb. Limb 30 has an inner surface 44 adjacent to an outer surface 46 on riser 26, and an outer surface 48 remote from riser 26. Surfaces 44, 48 preferably are flat and parallel. A bushing or limb bolt washer 50 has a flat undersurface 52 opposed to limb outer surface 48. A through-opening 54 extends through washer 50 between an upper surface 56 and undersurface 52. Surfaces 52, 56 preferably are flat, parallel to each other and perpendicular to the central axis of through-opening 54. A leg 58 extends from undersurface 52 at a position offset from through-opening 54. Leg 58 preferably is generally rectangular in construction, as best seen in FIGS. 7A–7D, and is disposed adjacent to the circular outer periphery of undersurface 52.

Figure 7A:
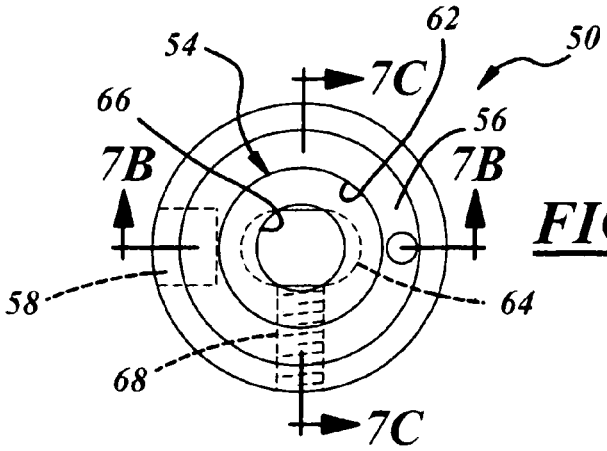
FIGS. 7A–7D are respective views of the limb bolt washer in the attachment construction of FIGS. 1–6.
Figure 7B:
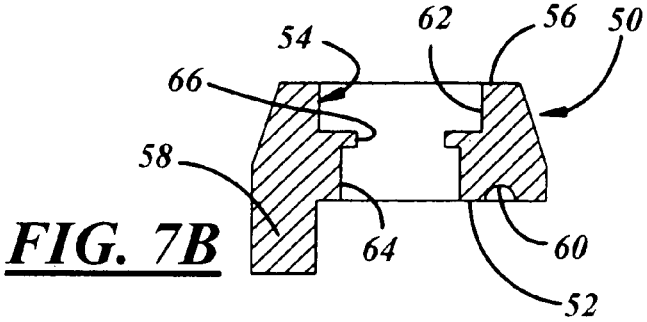
Figure 7C:
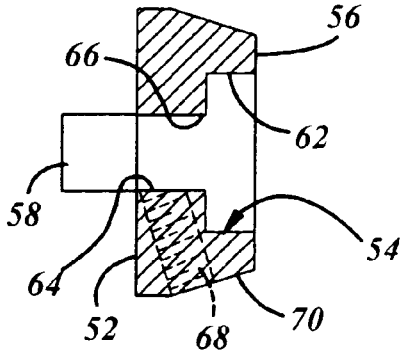
Figure 7D:
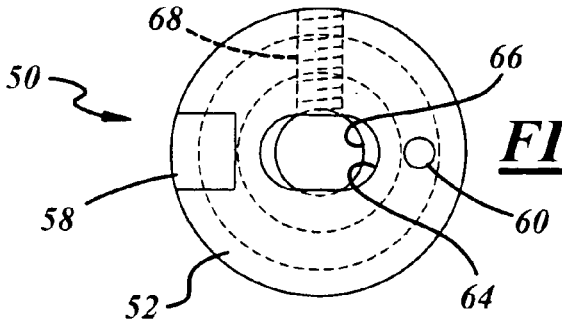
Figure 9A:
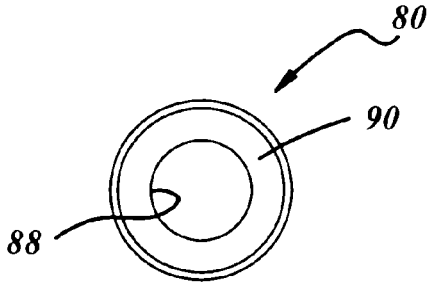
FIGS. 9A and 9B are respective views of the annular bearing washer in the attachment construction of FIGS. 1–6.
Figure 8A:
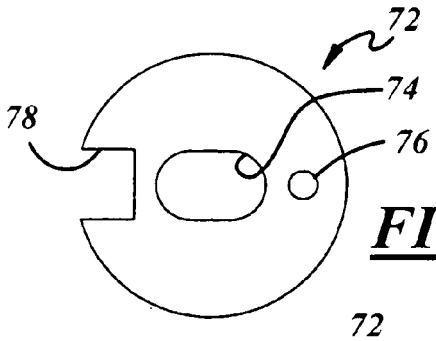
FIGS. 8A and 8B are respective views of the base washer in the attachment construction of FIGS. 1–6.
Figure 8B:
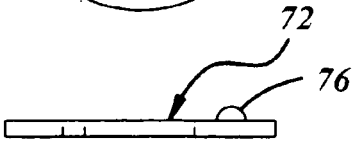
Figure 9B:
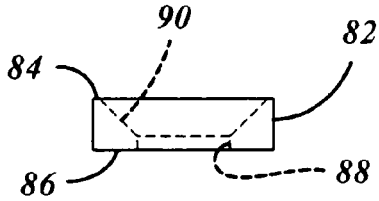

A pocket 60 is disposed on undersurface 52 at a position diametrically opposite from leg 58. Pocket 60 preferably is hemispheric in construction. The outer end of through-opening 54—i.e., the end of through-opening spaced from undersurface 52—has a cylindrical enlargement or countersink 62 coaxial with the axis of through-opening 54. The opposing end of through-opening 54—i.e., the end of the through-opening at undersurface 52—is in the form of a slot or oval 64 that is elongated in the direction between leg 58 and pocket 60, as best seen in FIG. 7D. There is a circular neck 66 of reduced diameter that connects countersink 62 with slot 64. An internally threaded opening 68 extends laterally from through-opening 54, radially outwardly with respect to the axis of through-opening 54 and preferably at an acute angle away from undersurface 52. Internally threaded opening 68 extends between slotted portion 64 of through-opening 54 and the outer peripheral surface 70 of washer 50. As best seen in FIG. 7D, opening 68 preferably is at a position mid-way or 90° between leg 58 and pocket 60, and opens into the narrow portion of slotted portion 64. Washer 50 may be of suitable rigid construction such as aluminum.

A base washer 72 (FIGS. 3–6 and 8A–8B) is disposed between undersurface 52 of washer 50 and opposing outer surface 48 of limb 26. Washer 72 preferably is in the form of a flat circular disc of plastic construction having parallel outer and inner faces. A through-opening 74 extends through the center of washer 72, and is elongated in the direction between a lug 76 (preferably hemispheric) and a diametrically opposed slot 78 that opens at the periphery of washer 72. Lug 76 is received in assembly within pocket 60 on undersurface 52 of washer 50, and leg 58 on washer 50 extends through slot 78 of washer 72.

Figure 5:
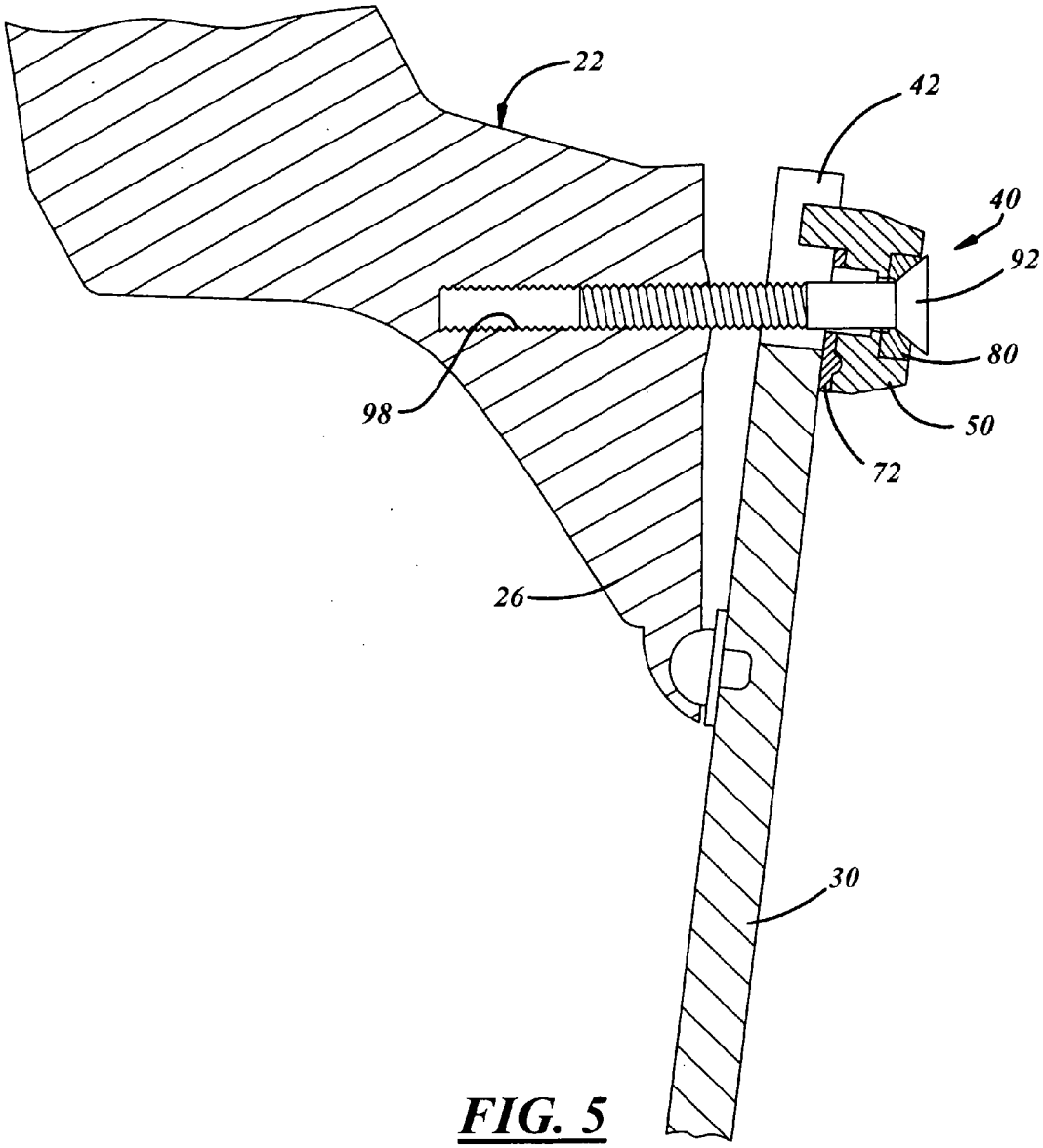
FIG. 5 is a fragmentary sectional view that illustrates operation of the present invention during adjustment of bow draw weight.

An annular bearing washer 80 has a cylindrical outer peripheral surface 82 that is received within countersunk portion 62 of washer through-opening 52. The thickness of bearing washer 80, between parallel outer and inner surfaces 84, 86, preferably is such that outer surface 84 of washer 80 is flush with outer surface 56 of washer 50 in assembly. Bearing washer 82 has a through-opening 88 that has a conical countersink 90 at outer surface 84. Bearing washer 80 may be of suitable bearing material such as acetal, and preferably is press-fit within countersunk portion 62 in through-opening 54 of washer 50. A cap screw 92 has a conical head 94 that is received within countersunk portion 90 of through-opening 88 in bearing washer 80, and an externally threaded shank 96 that extends through through-opening 88 in bearing washer 80, through-opening 54 in limb bolt washer 50, through-opening 74 in base washer 72 and non-round opening 42 in limb 30 into an internally threaded opening 98 in handle riser 26. Leg 58 on limb bolt washer 50 extends through slot 78 in base washer 72 into non-round opening 42 in limb 30 to prevent rotation of limb bolt washer 50 with respect to limb 30. Lug 76 and slot 78 in base washer 72 also maintain alignment of base washer 72 with respect to undersurface 52 of limb bolt washer 50. Bearing washer 80 facilitates free rotation of screw 92 with respect to limb bolt washer 50 and riser 26 and adjustment of bow draw weight, as illustrated in FIG. 5, without excess friction between screw 92 and limb bolt washer 50. A set screw 100 is received in opening 68 of limb bolt washer 50 to engage shank 96 of screw 92 and lock screw 92 in position.

To adjust bow draw weight, set screw 100 is loosened and cap screw 92 is threaded into or out of opening 98, as shown in FIG. 5. Limb 30 is biased against screw 92 by cable system 36 (FIG. 1). Washer 80 reduces friction between screw 92 and washer 50, reducing or eliminating noise and galling. When the desired bow draw weight is achieved, set screw 100 is retightened. The outward angle of set screw opening 68 in washer 50 facilitates adjustment of the set screw without interference with outer limb surface 48, or with the walls of a pocket in the limb into which the limb washer is recessed. The slotted construction of opening 74 in washer 72 and opening portion 64 in washer 50 accommodate the angled orientation of screw 92 illustrated in FIG. 5.

There thus has been disclosed an archery bow limb attachment construction that fully satisfies all of the objects and aims previously set forth. The invention has been disclosed in conjunction with a presently preferred embodiment thereof, and a number of modifications and variations have been discussed. Other modifications and variations readily will suggest themselves to persons of ordinary skill in the art in view of the foregoing discussion. The invention is intended to embrace all such modifications and variations as fall within the spirit and broad scope of the appended claims.

The invention claimed is:

1. An archery bow limb attachment construction that includes:

an archery bow handle riser having an internally threaded opening, an archery bow limb having opposed flat surfaces and a non-round opening extending between said surfaces, a limb bolt washer having a flat undersurface opposed to one of said flat surfaces on said limb, a leg extending from said undersurface into said non-round opening to prevent rotation of said limb bolt washer with respect to said limb, a through-opening having a cylindrical countersink at an end opposed to said undersurface, and an internally threaded lateral opening communicating with said through-opening between said countersink and said undersurface, an annular bearing washer having a cylindrical outer periphery received in said countersink of said through-opening in said limb bolt washer and a through-opening having a conical countersink remote from said limb bolt washer, a cap screw having a head received in said conical countersink of said bearing washer and an externally threaded shank that extends through said through-openings in said bearing washer and said limb bolt washer, through said non-round opening in said limb and into said internally threaded opening in said handle riser, and a set screw in said lateral opening in said limb bolt washer for locking said cap screw against rotation with respect to said limb bolt washer.

2. The construction set forth in claim 1 including a base washer disposed between said bow limb and said undersurface of said limb bolt washer, said base washer having a through-opening through which said cap screw shank is received and a lug received in a pocket on said undersurface of said limb bolt washer to prevent rotation of said base washer with respect to said limb bolt washer.

3. The construction set forth in claim 2 wherein said base washer includes an opening for receiving said leg of said limb bolt washer.

4. The construction set forth in claim 3 wherein said opening in said base washer for receiving said leg is a slot that opens at a periphery of said base washer diametrically opposite from said lug.

5. The construction set forth in claim 3 wherein said limb bolt washer through-opening is enlarged at said undersurface to accommodate rocking of said cap screw with respect to said limb bolt washer.

6. The construction set forth in claim 5 wherein said through-opening in said base washer is elongated to accommodate rocking of said cap screw with respect to said base washer.

7. The construction set forth in claim 1 wherein said internally threaded lateral opening extends from said through-opening of said limb bolt washer at an angle away from said undersurface.

8. The construction set forth in claim 1 wherein said bearing washer is received by press fit within said countersink of said through-opening in said limb bolt washer.

9. An archery bow limb attachment construction that includes:

an archery bow handle riser having an internally threaded opening, an archery bow limb having opposed flat surfaces and a slot extending from an end of said limb between said surfaces, a limb bolt washer having a flat undersurface opposed to an outer one of said flat surfaces on said limb, a central through-opening having a cylindrical countersink at an outer surface opposed to said undersurface and a slotted end at said undersurface, a leg offset from said through-opening extending from said undersurface into said slot in said bow limb, a pocket in said undersurface diametrically opposite from said leg across said through-opening, and an internally threaded lateral opening communicating with said through-opening at said slotted end and extending to a periphery of said limb bolt washer at an acute angle to said undersurface and at a position spaced 90° to a line between said leg and said pocket, a base washer disposed between said undersurface and said limb, said base washer having a lug received in said pocket, a peripheral notch that receives said leg, and a through-opening that is elongated in a direction between said notch and said lug, an annular washer of bearing material having a cylindrical periphery that is press fit in said cylindrical countersink of said limb bolt washer and a through-opening having a conical countersink remote from said limb bolt washer, a cap screw having a head received in said conical countersink of said bearing washer and an externally threaded shank that extends through said through-openings in said bearing washer, said limb bolt washer and said base washer, through said slot in said limb and into said internally threaded opening in said handle riser, and a set screw in said lateral opening in said limb bolt washer for locking said cap screw against rotation with respect to said limb bolt washer.

* * * * *